US009607779B2

(12) United States Patent
Park

(10) Patent No.: US 9,607,779 B2
(45) Date of Patent: Mar. 28, 2017

(54) EMERGENCY BUTTON FOR VEHICLE

(71) Applicant: Hyundai Motor Company, Seoul (KR)

(72) Inventor: June Ha Park, Seoul (KR)

(73) Assignee: Hyundai Motor Company, Seoul (KR)

( * ) Notice: Subject to any disclaimer, the term of this patent is extended or adjusted under 35 U.S.C. 154(b) by 170 days.

(21) Appl. No.: 14/528,506

(22) Filed: Oct. 30, 2014

(65) Prior Publication Data

US 2015/0235782 A1 Aug. 20, 2015

(30) Foreign Application Priority Data

Feb. 20, 2014 (KR) ..... 10-2014-0019485

(51) Int. Cl.

| | |
|---|---|
| ***H01H 1/64*** | (2006.01) |
| ***H01H 3/02*** | (2006.01) |
| ***G08B 5/00*** | (2006.01) |
| ***H01H 9/16*** | (2006.01) |
| ***G08B 5/36*** | (2006.01) |

(52) U.S. Cl.

CPC ..... *H01H 3/022* (2013.01); *G08B 5/002* (2013.01); *G08B 5/36* (2013.01); *H01H 9/161* (2013.01); *H01H 2215/03* (2013.01); *H01H 2219/036* (2013.01); *H01H 2219/056* (2013.01); *H01H 2221/0702* (2013.01)

(58) Field of Classification Search

CPC ..... H01H 3/022; H01H 3/12; H01H 9/161
USPC ..... 200/336, 273, 345, 344, 314
See application file for complete search history.

(56) References Cited

U.S. PATENT DOCUMENTS

| | | | | |
|---|---|---|---|---|
| 7,309,840 | B1 | 12/2007 | Lo | |
| 2002/0196618 | A1* | 12/2002 | Douzono | G06F 3/0202 362/84 |
| 2003/0160680 | A1* | 8/2003 | Hisamune | H01C 10/32 338/162 |
| 2005/0061651 | A1 | 3/2005 | Chou | |
| 2010/0321931 | A1* | 12/2010 | McDermott | F21L 4/027 362/190 |

(Continued)

FOREIGN PATENT DOCUMENTS

| | | |
|---|---|---|
| JP | 07-249349 | 9/1995 |
| JP | 2004-319258 A | 11/2004 |

(Continued)

*Primary Examiner* — Renee Luebke
*Assistant Examiner* — Ahmed Saeed
(74) *Attorney, Agent, or Firm* — Mintz Levin Cohn Ferris Glovsky and Popeo, P.C.; Peter F. Corless

(57) ABSTRACT

An emergency button for a vehicle used for emergency rescue when a vehicle accident or an emergency situation occurs has a design structure reflecting a design to prevent an erroneous operation for conforming to governmental regulations, and an intuitive human-machine interface (HMI) to allow a user to easily operate the emergency button and prevent an erroneous operation from being generated. The emergency button includes a case; a cap coupled to an upper portion of the case so as to move up and down during rotation; and a button part which is interfered in a rotation direction and slidably coupled with the cap to be rotated together with the cap, receives elastic support by a spring at a lower side to be movable up and down, and is in contact with the switch for transmitting a call connection signal within the case to transmit a call connection signal.

6 Claims, 6 Drawing Sheets

(56) References Cited

U.S. PATENT DOCUMENTS

| | | | | |
|---|---|---|---|---|
| 2015/0041289 | A1* | 2/2015 | Ely | H01H 3/122 200/4 |

FOREIGN PATENT DOCUMENTS

| | | | |
|---|---|---|---|
| JP | 3988646 | B2 | 10/2007 |
| JP | 4173336 | B2 | 10/2008 |
| KR | 10-2002-0009760 | A | 2/2002 |
| KR | 10-1997-0071878 | | 6/2005 |
| KR | 20-0470404 | Y1 | 1/2014 |

* cited by examiner

EMERGENCY BUTTON FOR VEHICLE

CROSS-REFERENCE TO RELATED APPLICATION

This application claims under 35 U.S.C. §119(a) the benefit of Korean Patent Application No. 10-2014-0019485 filed on Feb. 20, 2014, the entire contents of which are incorporated herein by reference.

BACKGROUND (a) Technical Field

The present disclosure relates to an emergency button for a vehicle. More particularly, it relates to an emergency button for a vehicle used for emergency rescue when a vehicle accident or an emergency situation occurs.

(b) Description of the Related Art

In order to notify others of a problem as the result of an accident or breakdown, a driver has traditionally used a method of notifying that there is a vehicle having a problem by preventing a neighboring vehicle from approaching with a hand signal, using the vehicle's hazard function that causes blinking of both turn signal lamps, or standing an emergency tripod at a predetermined distance near an accident.

It is known to provide a system for allowing a vehicle passenger to be connected to an emergency rescue center, and to receive support, such as a police patrol car and an ambulance, by pressing an emergency button inside the vehicle when a vehicle accident or other emergency situation has occurred.

Various forms of an emergency button for a vehicle related to an operation of the system are disclosed in US Patent Publication No. 2005-0061615, Japanese Patent Application Laid-Open No. 1995-249349, U.S. Pat. No. 7,309,840, and the like.

In the meantime, in order to prevent the emergency button from being pressed due to a mistake of a user, an automobile company is obligated to provide a suitable design for structurally preventing an erroneous operation.

For example, a method of preventing the emergency button from being erroneously operated includes a method adopting a cover, and this method is applied in a hinge type, a door type, and a cover breaking and pushing type according to a method of opening the cover.

Respective automobile companies take specific measures in designing a structure for preventing erroneous operation of the emergency button in order to respond to governmental regulations, and when the method of preventing the erroneous operation of the emergency button is designed in the most common type and old-fashioned door type, a button design and a cover design are reflected together, so that it is difficult to design the emergency button, and the emergency button occupies a large space, so that it is difficult to apply the door type to the vehicle.

The sliding type may add confusion to a user when an accident occurs, so that it is difficult to apply the sliding type to the vehicle considering an emergency situation, such as an accident.

The cover breaking and pushing type is a type, in which an upper end of the button is pressed while being broken, and is very inconvenient in a structural design, and is substantially damaged due to curiosity in daily life, so that the cover breaking and pushing type is also inappropriate for a vehicle.

The above information disclosed in this Background section is only for enhancement of understanding of the background of the invention and therefore it may contain information that does not form the prior art that is already known in this country to a person of ordinary skill in the art.

SUMMARY

The present invention provides a new type of emergency button for a vehicle, which has a design structure reflecting a design to prevent an erroneous operation for conforming to governmental regulations (e.g., in Europe), and an intuitive human-machine interface (HMI) to allow a user to easily operate the emergency button and prevent an erroneous operation from being generated.

In order to achieve the aforementioned object, the emergency button for the vehicle provided by the present invention has the following features.

In one aspect, the present invention provides an emergency button for a vehicle, including: a case in which a switch for transmitting a call connection signal is mounted; a cap coupled to an upper portion of the case in a screw-engagement structure to move up and down during rotation; and a button part which is interfered in a rotation direction and slidably coupled with the cap to be rotated together with the cap, receives elastic support by a spring at a lower side to be move up and down, and is in contact with the switch for transmitting a call connection signal within the case through a lower surface thereof to transmit a call connection signal.

Accordingly, the emergency button for the vehicle may transmit an emergency rescue signal when a vehicle accident or an emergency situation occurs, and effectively prevent an erroneous operation of the button.

In a preferred embodiment, upward movement of the button part may be limited by a stopper provided at an upper end of the case by using a latching part having an inclined structure formed along a circumference of an outer peripheral surface, and the button part may protrude from an upper surface of the cap when being rotated in a predetermined direction.

In another preferred embodiment, an LED and an LED-side contact point may be provided at the button part, and a power-side contact point is provided on a wall surface of the case, so that the LED may be turned on when both contact points are connected with each other according to the rotation of the button part, and the button part may be made of a light emitting material, which allows light to be diffused, so that the entire button part may emit light while light is diffused together with the turning on of the LED.

In still another preferred embodiment, a pad which is capable of turning on the switch by pressing the switch for transmitting a call connection signal may protrude from the bottom surface of the button part, so that the switch for transmitting a call connection signal may be more easily operated.

In yet another preferred embodiment, a character figure part shaped like "SOS" may be formed at the button part, and a character figure part hole corresponding to the character figure part of the button part may be formed at the cap, so that the character figure part may protrude from the upper surface of the cap when the button part moves up.

In still yet another preferred embodiment, a proximity sensor may be attached onto the upper surface of the button part, so that an audio guidance or a screen guidance, which notifies generation of an emergency situation when a movement of a user is sensed, may be provided to a user.

The emergency button for the vehicle provided by the present invention has the following advantages.

First, the emergency button for the vehicle has a structure capable of preventing an erroneous operation under a usual daily driving condition, thereby conforming to applicable governmental regulations (e.g., those of Europe and Russia).

Second, when an accident occurs, it is possible to support a smooth and intuitive function operation.

Third, a red lighting or color may be applied to the emergency button, thereby minimizing creation of anxiety of a driver.

Accordingly, the emergency button satisfies the structure to prevent an erroneous operation, which is the normally the applicable governmental regulation, and serves to connect an operation so as for a user to easily perform a subsequent operation, so that it is possible to effectively handle an emergency situation and receive an emergency rescue when the emergency situation occurs.

Other aspects and preferred embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

BRIEF DESCRIPTION OF THE DRAWINGS

The above and other features of the present invention will now be described in detail with reference to certain exemplary embodiments thereof illustrated by the accompanying drawings which are given hereinbelow by way of illustration only, and thus are not limitative of the present invention, and wherein.

Figure 1A:
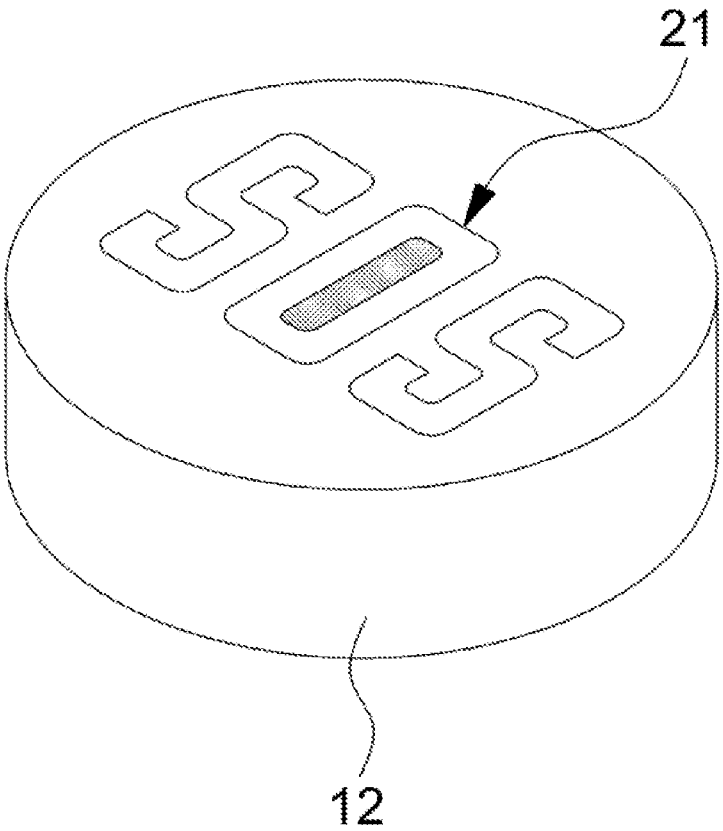
FIGS. 1A-1B are perspective views illustrating an example of an emergency button for a vehicle according to the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present disclosure, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Hereinafter, exemplary embodiments of the present disclosure so as to be easily practiced by a person skilled in the art to which the present disclosure pertains will be described in detail with reference to the accompanying drawings.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

An emergency button of the present invention is a button pressed by a vehicle passenger when a vehicle accident or an emergency situation occurs, and the vehicle passenger may be connected to an emergency rescue center or receive a support, such as a police patrol car and an ambulance, through an operation of the button.

An appearance of the emergency button preferably is designed in a cylindrical shape, and the letters "SOS" and a lighting may be applied to a center of a plane surface for the purpose of notification to a user.

Although the letters "SOS" preferably are used, different letters or another word or symbol may be substituted. For example, a large exclamation point or caution symbol may be used.

The emergency button is a safety-related button, so that larger font and size than those of other buttons are maintained, and for example, a translucent white plastic material, which allows light to pass through, is applied to "SOS".

The lighting of "SOS" is usually maintained with a white color, but is automatically changed to have red when a use of the emergency button is necessary due to generation of an emergency situation, and in this case, the alphabet letters "SOS" are separated from an external cap to protrude in a form of a button so as for a user to easily press the alphabet letters "SOS".

In order to prevent an erroneous operation of the emergency button, the external cap does not have a structure which is pressed by the user, and the "SOS" button is not pressed.

When the external cap is rotated by 180° in a clockwise direction, the "SOS" button is separated from the external cap to protrude in an upper direction, and the external cap is depressed in a lower direction.

Even though the rotation angle in this case is 180°, upper and lower portions of the alphabet letters "SOS" are changed, "SOS" is read as it is, and simultaneously the color of the lighting of the "SOS" button is changed to red, so that an HMI receiving a confirmation of a call start from the user may be executed.

Hereinafter, the present invention will be described in detail with reference to the accompanying drawings.

Figure 1B:
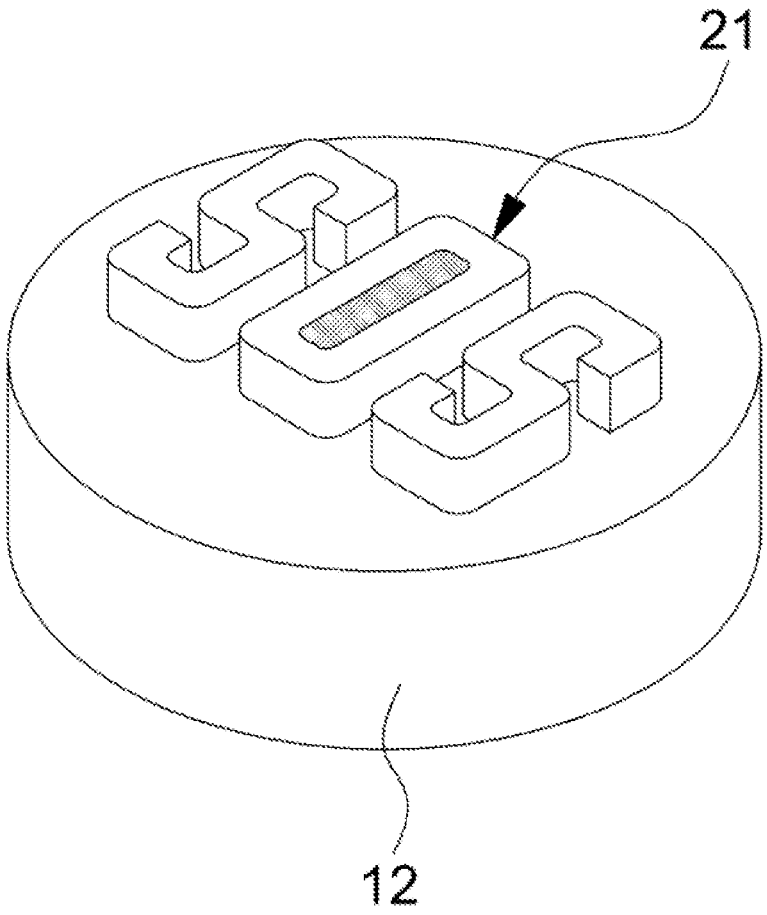
Figure 2A:
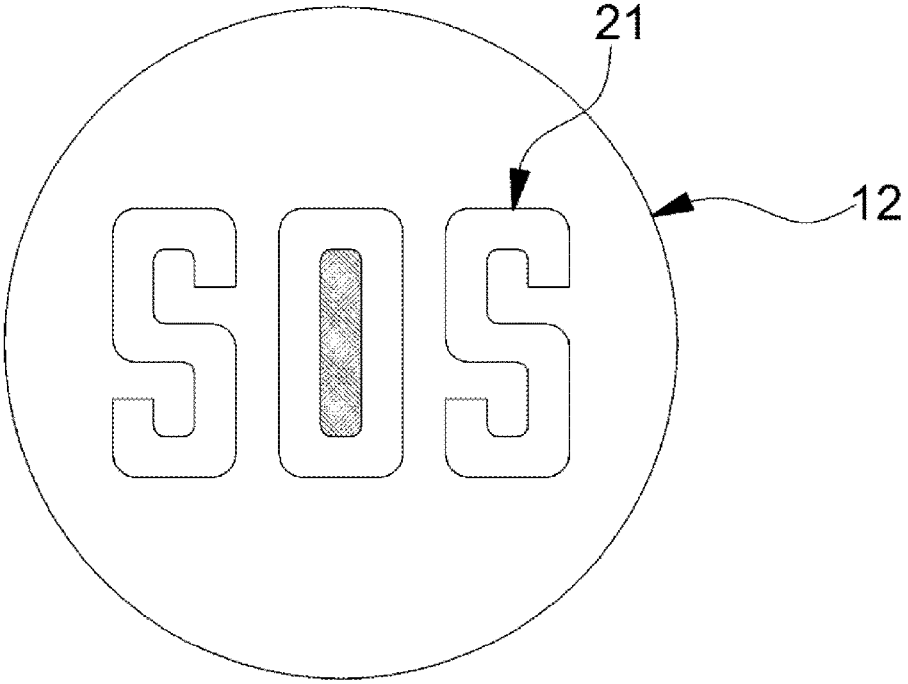
FIGS. 2A-2B are plan views and cross-sectional views illustrating an example of the emergency button of FIGS. 1A-1B.
Figure 2B:
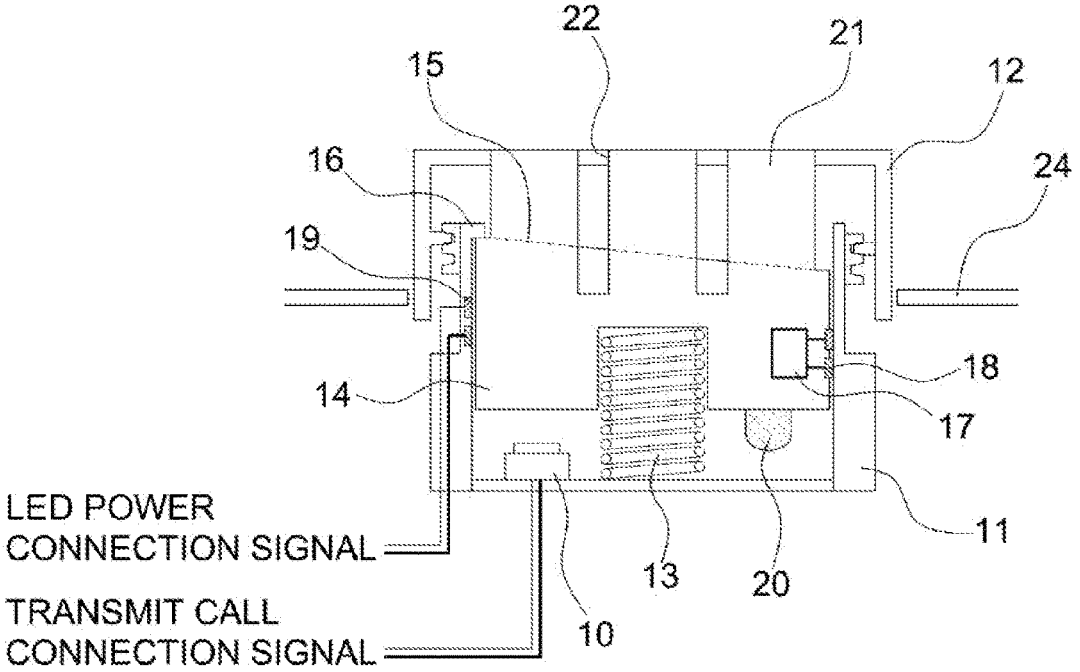

FIGS. 1A-1B are perspective views illustrating an example of an emergency button for a vehicle according to the present invention, and FIGS. 2A-2B are plan views and cross-sectional views illustrating an example of the emergency button of FIGS. 1A-1B.

As illustrated in FIGS. 1A-1B and 2A-2B, the emergency button for the vehicle includes a case 11 and a cap 12, which are screw-engaged with each other, and a button part 14 accommodated inside the case 11 and the cap 12, and the button may be operated by a method of pressing the button part 14 protruding in an upper direction when the cap 12 is rotated.

To this end, the case 11 is an approximately cylindrical case having an opened upper portion, and a screw thread to be coupled with the cap side is formed on an outer peripheral surface of an upper end of the case 11, and a power-side contact point 19 for making an LED be turned on is mounted at one side of a wall body.

The case 11 may be installed in a structure supported by an internal side of a panel 24 for interior decoration, such as an instrument and a fascia.

A switch 10 for transmitting a call connection signal is installed on a bottom inside the case 11, and when the switch 10 for transmitting a call connection signal is pressed by an operation of the button part 14, a signal for signal connection may be transmitted by an emergency rescue center, and the like.

The cap 12 is an approximately cylindrical cap, and is coupled in a structure engaged with an upper portion of the case 11 by using the screw thread formed on an internal peripheral surface.

Accordingly, when the cap 12 is turned, the cap 12 may move down or up by the screw engagement structure.

A character figure part hole 22, to which a character figure part 21 of the button part 14 is fitted, is formed in an upper portion of the cap 12, and, as shown in FIG. 1B, the character picture part 21 may be interfered in a rotation direction through the character figure part hole 22, and simultaneously slide in a vertical direction, and protrude in an upper direction or enter in an internal direction.

Herein, the character figure part hole 22 may be a hole having a shape corresponding to a shape of the character figure part 21, and for example, when the character figure part 21 is formed in a shape of "SOS", the character figure part hole 22 may have a hole shaped like "SOS".

The cap 12 may be positioned in an exposed (protruding) state to the outside of the panel 24 for interior decoration in the state where the cap 12 is coupled with the case 11, and as another example, the cap 12 may be positioned in the state where an upper surface of the cap 12 configures the same surface as a surface of the panel 24 for interior decoration by forming recesses at the panel 24 for interior decoration around the cap.

In this case, the cap 12 may be set to be rotated within a range of 180°, protrusions (not illustrated) which may be interfered with each other is formed in a screw-engaged portion between the cap 12 and the case 11 so that when the cap is rotated by 180° with the rotational operation of the cap, the cap may be prevented from being turned any longer.

The button part 14 is a part which is directly pressed and operated by the user, generally has an approximately cylindrical shape, and is provided with the character figure part 21 formed in the shape of the predetermined characters, for example, the alphabetical characters of "SOS", at an upper end thereof.

The button part 14 may be made of a light emitting material allowing light to be diffused, for example, a transparent or translucent plastic material, and thus, when the LED is turned on, light is diffused to the entire button part 14 including the character figure part 21, so that the entire button part emits light, and as a result, the user may more easily recognize an operation of the button.

The button part 14 is inserted and positioned inside the case 11, and is installed in a structure coupled with the cap 12 by using the character figure part 21.

In particular, the character figure part 12 of the button part 14 is fitted to the character figure part hole 22 provided in the cap 12, and thus, the button part 14 may be rotated together with the cap 12 by interference between the character figure part 21 and the character figure part hole 22 when the cap 12 is rotated, and the character figure part 21 of the button part 14 may protrude from the upper surface of the cap 12 while vertically sliding through the character figure part hole 22.

The button part 14 always receives force to move in the upper direction, and to this end, a spring 13 is interposed between a lower surface of the button part 14 and a bottom surface of the case 11, and the button part 14 may always receive force to move in the upper direction by force applied from the spring 13.

Particularly, the button part 14 includes a structure which moves in the upper direction by receiving force of the spring 13 at a lower side while being rotated together with the cap 12.

To this end, the button part 14 is provided with a latching part 15 which has a stepped structure with respect to an outer peripheral surface of the button part 14 and is inclined along a circumference of the outer peripheral surface of the button part 14.

A length of an inclined section of the latching part 15 may have a length formed over a longer section than a section of 180° of the circumference of the button part.

The latching part 15 of the button part 14 may be caught by a stopper 16 protruding from one side to an internal side of the upper end of the case 11, and in this case, the moving-up of the button part 14 may be limited by the latching part 15 caught by the stopper 16.

Accordingly, when the button part 14 is rotated, the button part 14 may be directed up or down by the latching part 15 caught by the stopper 16 to move up or down while having a structure inclined in the rotation direction, and as a result, when the button part 14 moves up, the button part 14 may protrude from the upper surface of the cap 12.

An LED 17 is mounted at an internal side and an LED-side contact point 18 is exposed at an outer peripheral surface side at one side of a lower end of the button part 14, and in this case, the LED-side contact point 18 is connected with the power side contact point 19 formed on the wall surface of the case 11, so that the entire button part 14 emits light along with the turning on of the LED.

In this case, the LED-side contact point 18 included in the button part 14 and the power-side contact point 19 included in the case 11 are positioned with a phase difference of 180°, so that when the button part 14 is rotated by 180°, the contact points at both sides may be connected with each other to turn on the LED 17.

A pad 20 protrudes from the lower surface of the button part 14, and the pad 20 is connected with the switch 10 for transmitting a call connection signal provided at the case 11 to serve to turn on the switch 10 for transmitting a call connection signal when the button part 14 is pressed in the down direction.

It is a matter of course that the pad 20 and the switch 10 for transmitting a call connection signal are also positioned with the phase difference of 180°, so that the operation of turning on the switch 10 for transmitting a call connection signal may be performed at a position where the button part 14 is rotated 180°.

Figure 3A:
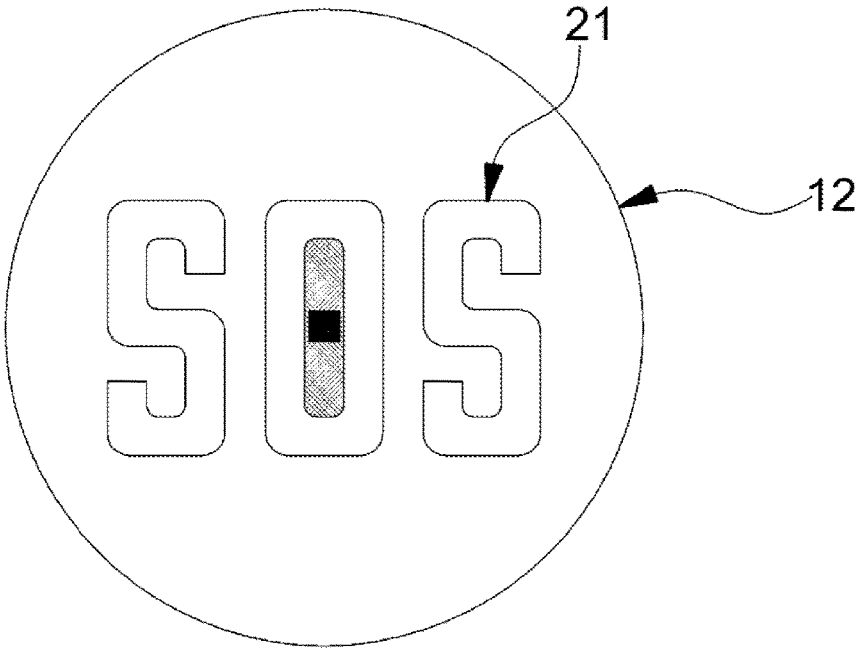
FIGS. 3A-3B are plan views and cross-sectional views illustrating another example of an emergency button for the vehicle according to the present invention.
Figure 3B:
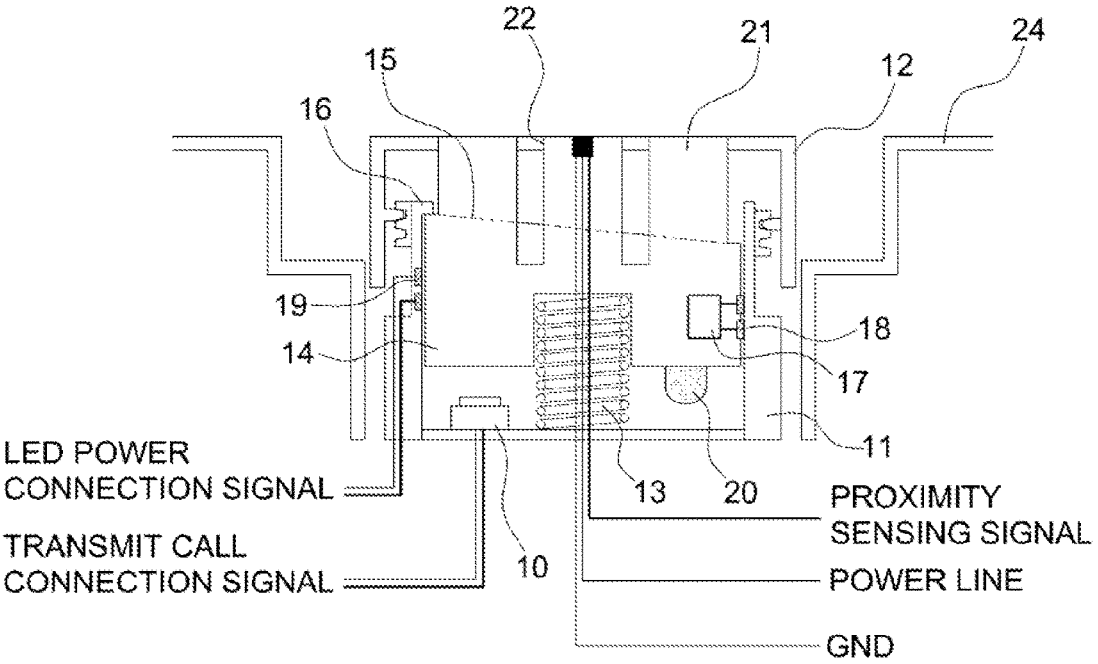

FIGS. 3A-3B are plan views and cross-sectional views illustrating another example of an emergency button for a vehicle according to the present invention.

As illustrated in FIGS. 3A-3B, structures and coupling relations of a case 11, a cap 12, and a button part 14 in the present example are the same as those of the aforementioned example, and particularly, it is illustrated a method in which the emergency button for the vehicle adopts a proximity sensor 23 to more actively handle an emergency situation.

To this end, the proximity sensor 23 is attached on an upper surface of the button part 14 or an upper surface of the cap 12, and in this case, the proximity sensor 23 is electrically connected with a vehicle control unit side, such as an ECU.

Accordingly, before operating the emergency button, when a vehicle passenger moves his/her hand and the like to an upper side of the emergency button provided with the proximity sensor 23, the proximity sensor 23 senses the movement, and a sensing signal may be input into the vehicle control unit side to be used for providing various guidance to the vehicle passenger.

For example, a guide speech "In the case of an emergency situation, turn the emergency button in a clockwise direction, and then press a flickering button" may be provided through a speaker as an audio guidance.

A phrase "In the case of an emergency situation, turn the emergency button in a clockwise direction, and then press a flickering button" may be displayed in a form of a pop-up window as a screen guidance using an AVN screen display (pop-up window).

An upper surface of the cap 12 including the button part 14 may have the same height as that of a panel 24 for interior decoration, and the user may easily turn and operate the button part 14 by inserting his/her finger to a recess portion formed along a peripheral circumstance of the button part 14 during the operation.

Accordingly, a use state of the emergency button for the vehicle configured as described above will be described below.

Figure 4A:
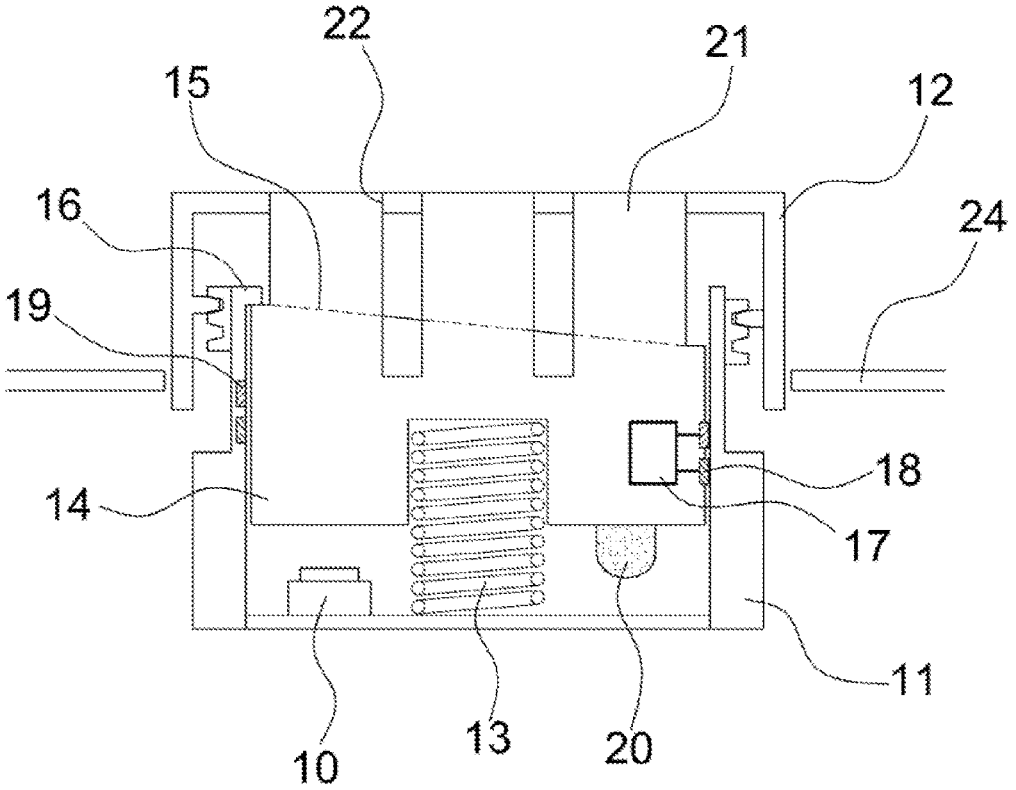
FIGS. 4A-4C are plan views and cross-sectional views illustrating a use state of the emergency button for the vehicle according to the present invention.
Figure 4B:
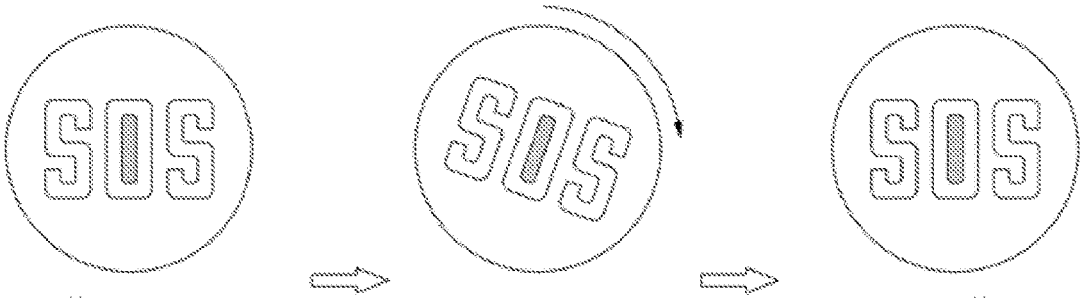
Figure 4C:
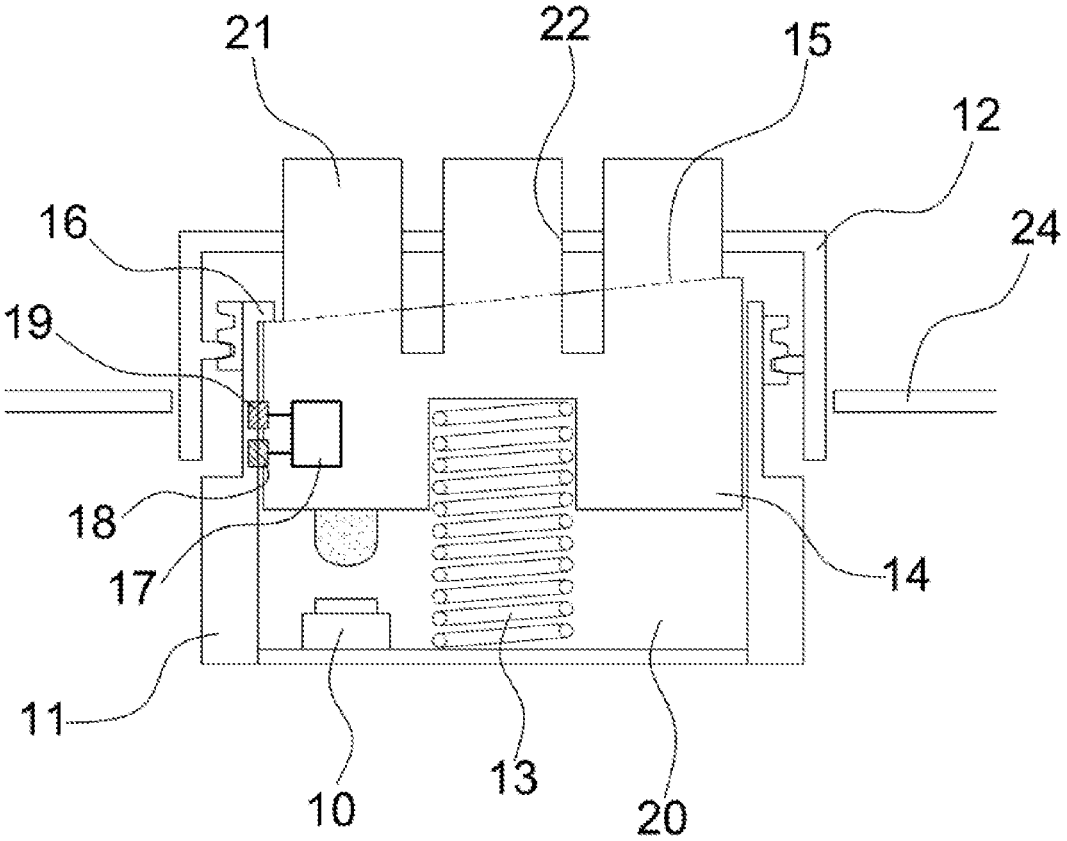

FIGS. 4A-4C are plan views and cross-sectional views illustrating a use state of the emergency button for the vehicle according to the present invention.

As illustrated in FIG. 4A, the button part 14 of the emergency button may be usually pressed in the down direction, but the pad 20 formed on the lower surface of the button part 14 is first in contact with the floor of the case 11, so that the switch 10 for transmitting a call connection signal is not operated, thereby preventing an erroneous operation of the emergency button due to a mistake of a passenger.

When the vehicle passenger turns the cap 12 in the clockwise direction, as shown in the sequence of FIG. 4B, during the generation of a vehicle accident or an emergency situation, the button 14 moves in the upper direction by the latching part 15 having the inclined structure while being rotated together with the cap 12 (in this case, the cap 12 moves in the down direction as a matter of course), as shown in FIG. 4C.

Subsequently, when the cap 12 and the button part 14 are in the completely rotated state by 180°, the character figure part 21 of the button part 14 protrudes from the upper surface of the cap and the LED 17 is turned on, so that the character figure part 21 exposed to the outside emits light.

Further, the pad 20 included in the button part 14 is also positioned at a side just above the switch 10 for transmitting a call connection signal provided at the case 11, as shown in FIG. 4C.

In this case, when the button part 14 is pressed in the down direction, the switch 10 for transmitting a call connection signal is turned on by the pad 20, and a signal in this case is transmitted to an emergency rescue center, a police patrol car, an ambulance, and the like, so that the user may receive a support.

When the cap 12 is rotated 180° in the counterclockwise direction in the case where the vehicle accident or the emergency situation is released, the protruding character figure part 21 enters in the internal direction while the cap 12 moves up and the character figure part 21 of the button part 14 moves down, and the LED 17 is turned off, so that the emergency button returns to an initial state before the use.

As described above, according to the present invention, it is possible to smoothly and rapidly receive a support through an operation of the emergency button during generation of an accident, and above all things, it is possible to conform to the regulations, such as prevention of an erroneous operation of the emergency button in a usual daily condition.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. An emergency button for a vehicle, comprising:

a case in which a switch for transmitting a call connection signal is mounted;

a cap coupled to an upper portion of the case in a screw-engagement structure to move up and down during rotation; and a button part which is interfered in a rotation direction and slidably coupled with the cap to be rotated together with the cap, receives elastic support by a spring at a lower side to be movable up and down, and is in contact with the switch for transmitting a call connection signal within the case through a lower surface thereof to transmit a call connection signal, wherein upward movement of the button part is limited by a stopper provided at an upper end of the case by using a latching part having an inclined structure formed along a circumference of an outer peripheral surface, and the button part protrudes from an upper surface of the cap when being rotated in a predetermined direction.

2. The emergency button of claim 1, wherein an LED and an LED-side contact point are provided at the button part, and a power-side contact point is provided on a wall surface of the case, so that the LED is turned on when both contact points are connected with each other according to the rotation of the button part.

3. The emergency button of claim 1, wherein the button part is made of a light emitting material, which allows light to be diffused, so that the entire button part emits light while light is diffused together with the turning on of the LED.

4. The emergency button of claim 1, wherein a pad which is capable of turning on the switch by pressing the switch for transmitting a call connection signal protrudes from the bottom surface of the button part.

5. The emergency button of claim 1, wherein a character figure part is formed at the button part, and a character figure part hole corresponding to the character figure part of the button part is formed at the cap, so that the character figure part protrudes from the upper surface of the cap when the button part moves up.

6. The emergency button of claim 1, wherein a proximity sensor is attached onto the upper surface of the button part, so that an audio guidance or a screen guidance which notifies generation of an emergency situation when a movement of a user is sensed, is provided to a user.

* * * * *